US005579844A

United States Patent [19]

Rebardi et al.

[11] Patent Number: 5,579,844

[45] Date of Patent: Dec. 3, 1996

[54] SINGLE TRIP OPEN HOLE WELL COMPLETION SYSTEM AND METHOD

[75] Inventors: Wade Rebardi, Carencro; Donald H. Michel, Broussard, both of La.

[73] Assignee: OSCA, Inc., Lafayette, La.

[21] Appl. No.: 387,607

[22] Filed: Feb. 13, 1995

[51] Int. Cl.[6] ..... E21B 43/10; E21B 43/12

[52] U.S. Cl. ..... 166/296; 166/126; 166/158; 166/205; 166/369

[58] Field of Search ..... 166/205, 369, 166/296, 157, 158, 142, 126, 278, 51, 128, 131

[56] References Cited

U.S. PATENT DOCUMENTS

| | | | |
|---|---|---|---|
| 2,419,313 | 4/1947 | Byrd | 166/296 X |
| 3,741,300 | 6/1973 | Wolff et al. | 166/184 |
| 3,987,854 | 10/1976 | Callihan et al. | 166/51 X |
| 4,606,408 | 8/1986 | Zunkel et al. | 166/278 |
| 4,858,690 | 8/1989 | Rebardi et al. | 166/278 |
| 4,928,772 | 5/1990 | Hopmann | 166/386 |
| 5,174,379 | 12/1992 | Whiteley et al. | 166/278 |
| 5,295,538 | 3/1994 | Restarick | 166/205 |
| 5,377,750 | 1/1995 | Arterbury et al. | 166/205 |

*Primary Examiner*—Hoang C. Dang
*Attorney, Agent, or Firm*—Woodard, Emhardt, Naughton, Moriarty & McNett

[57] ABSTRACT

A well completion system which includes a production packer assembly, production tubing sealed to the packer assembly, and an isolation assembly coupled with the packer assembly. The isolation assembly includes an isolation pipe received within a production screen and sealed at both ends therewith. The isolation pipe defines at least one port and carrying a moveable sleeve defining at least one aperture. The sleeve is moveable between an open position in which the port and aperture are in communication to permit fluid flow therethrough, and a closed position in which the port and aperture are not in communication and fluid flow is prevented. The isolation system is also coupled with a wash down shoe and a shearable ball seat. The well completion method includes running the completion system into a well with the isolation sleeve in the closed position, positioning a ball in the ball seat to close fluid flow, increasing fluid pressure within the production packer assembly to set and seal the packer against the casing, and then further increasing fluid pressure to displace the ball seat and open a fluid bypass. Coil tubing is then run into the well and the top isolation sleeve is opened and fluid is circulated out the end of and upwardly around the well completion assembly and back in through the production screen and isolation port to eliminate the filter cake in the open hole of the well. Any remaining isolation sleeves are opened and the coil tubing is removed to establish the well for production.

5 Claims, 2 Drawing Sheets

SINGLE TRIP OPEN HOLE WELL COMPLETION SYSTEM AND METHOD

BACKGROUND OF THE INVENTION

1. Field of the Invention

The present invention relates to the field of well completion systems and methods, and particularly to a system and method for open hole well completion in a single trip.

2. Description of the Prior Art

The present invention provides a system and method for open hole well completion in a single trip. In the past, it has been necessary to make at least two trips into an open hole well in order to effect well completion. The need to run equipment into the well more than once involves additional time and expense which are obviated by the present invention.

In accordance with the prior art, well completion has typically involved multiple steps, i.e. trips into the well. In the first step, the packer is run into the hole and set, followed by conventional circulation and breaker soak. With the elimination of the filter cake, it is possible to lose fluid to the open hole. Therefore, a fluid loss control device is used, typically employing a frangible item which needs to be broken for production of the well. Following setting of the packer, the work string including the setting tool is removed from the well. The production tubing is then run into the well as the final step to prepare for production of the well.

In contrast to the prior art, the present invention utilizes a system which does not require that the production tubing be run into the well separately. Rather, the production tubing is assembled with the packer for the initial run into the well bore, and continuous coil tubing is thereafter used to open the well for production. The present invention thereby provides both time and cost advantages over the prior art methods involving multiple trips into the well. For example, running coil tubing into the well may take about four hours to complete at a cost of approximately $10,000. By comparison, running the second trip into the well in accordance with prior art methods can take twenty four hours, at a cost of $60,000.

The present invention also is distinctive in its use of an isolation sleeve which is installed inside the production screen at surface and thereafter controlled in the well bore by means of an inner service string. In contrast, the prior art has used systems which involve intricate positioning of tools which are installed down-hole after the gravel pack. These prior art systems are exemplified by a commercial system available from Baker. This system utilizes an anchor assembly which is run into the well bore after the gravel pack. The anchor assembly is released by a shearing action, and subsequently latched into position.

Certain disadvantages have been identified with the systems of the prior art. As previously indicated, prior conventional isolation systems have had to be installed after the gravel pack, thus requiring greater time and extra trips to install the isolation assemblies. Also, prior systems have involved the use of fluid loss control pills after gravel pack installation, and have required the use of thru-tubing perforation or mechanical opening of a wireline sliding sleeve to access alternate or primary producing zones. In addition, the installation of prior systems within the well bore requires more time consuming methods with less flexibility and reliability than a system which is installed at the surface.

There has therefore remained a need for an isolation system for well control purposes and for well bore fluid loss control which combines simplicity, reliability, safety and economy, while also affording flexibility in use. The present invention satisfies this need, utilizing an isolation system which does not require the running of tailpipe and isolation tubing separately. Instead, the present system uses the same pipe to serve both functions: as tailpipe for circulating-style treatments and as production/isolation tubing.

SUMMARY OF THE INVENTION

Briefly describing one aspect of the present invention, there is provided an open hole completion system and method useful for completing a well with a single trip into the well bore. The system includes a packer assembly sealable with production tubing and coupled with an isolation assembly extending distally therefrom. The isolation assembly comprises a production screen, an isolation pipe mounted to the interior of the production screen, the isolation pipe being sealed with the production screen at proximal and distal ends, and a sleeve movably coupled with the isolation pipe, the isolation pipe defining at least one port and the sleeve defining at least one aperture, the sleeve having an open position with the aperture of the sleeve in fluid communication with the port in the isolation pipe and permitting fluid passage between the exterior of the screen and the interior of the isolation pipe, the sleeve also having a closed position with the aperture of the sleeve not in fluid communication with the port of the isolation pipe and preventing fluid passage between the exterior of the screen and the interior of the isolation pipe. The present invention also provides a method for completion of a well which includes running the single trip completion system into the well, setting the packer, and moving the sleeve of the isolation assembly to the open position to permit well production.

It is an object of the present invention to provide a versatile well completion system and method that combines simplicity, reliability, safety and economy with optional methods of operation.

Another object of the present invention is to provide a well completion system which includes an isolation system permanently installed inside the production screen at surface prior to running into the well.

Further objects and advantages of the present invention will be apparent from the description of the preferred embodiment which follows.

DESCRIPTION OF THE PREFERRED EMBODIMENT

Figure 1:
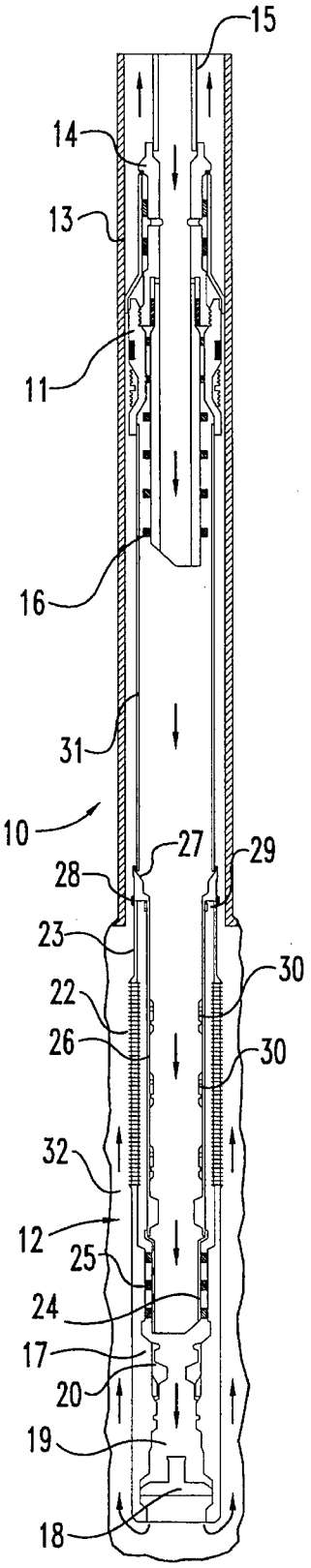
FIG. 1 is a side, cross-sectional, diagrammatic view of a well completion system in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In accordance with the present invention, a single trip open hole well completion system and method are provided. The system includes the combination of a packer, production tubing, production screen and an isolation system which is made up prior to running the system into the well bore. This yields an installation with advantages of time and economy, and also in respect to the subsequent operation of the system.

In the preferred embodiment, the system includes a gravel packer coupled with an isolation system including a pipe and sliding valve sleeve permanently coupled with the production screen at surface prior to running into the well. The isolation system is sealed at the proximal and distal ends of the production screen and provides a valving action such that shutting off the isolation system prevents fluid communication from the exterior of the production screen to the interior of the isolation system. The isolation system may be configured in a variety of ways to accomplish this valving action.

In FIG. 1 there is provided a diagrammatic view of a well completion system in a well in accordance with the present invention. The system 10 includes a production packer assembly 11 coupled with an isolation assembly 12. In conventional fashion, the production packer assembly is operable to grip and seal with the well casing 13. A hydraulic set and release tool 14 is connected with production tubing 15 and production seal assembly 16 and is used to set the production packer assembly within the casing.

The isolation assembly 12 includes at its distal end an assembly 17 which is of known configuration. The assembly 17 includes a wash down set shoe 18 which is a spring-loaded, one-way check valve. The wash down shoe is spring biased upwardly in the figure and in that position (FIG. 3) prevents fluid flow up through the central passageway 19. However, fluid flow downwardly through the passageway 19 forces the shoe to the open position (FIG. 1), permitting fluid to flow past the shoe. The valve assembly 17 also includes a ball seat 20 that includes a shearable connection that permits it to be displaced downwardly in the figures. In the initial, top position (FIG. 1), the ball seat will sealingly receive a ball 21, thereby preventing fluid flow through the center of the valve seat. However, upon displacement of the valve seat to a lower position (FIG. 4), fluid is permitted to flow past the valve seat even with the ball in position on the seat. The wash down set shoe and the ball valve seat as employed in the valve assembly 17 are conventional in the industry, and further description is therefore not provided herein.

The upper end of the valve assembly is connected with a production screen 22, which is in turn connected with blank pipe 23. Received within the upper portion of the valve assembly 17 is a seal assembly 24 sealed with the valve assembly by a seal bore 25. Seal assembly 24 is threaded to an isolation pipe 26. Blank pipe 23 and isolation pipe 26 are in turn secured to a coupling 27 by means of collars 28 and 29, respectively, threaded to the coupling. Therefore, the isolation pipe is sealed on both the proximal and distal ends of the production screen, and fluid communication from the exterior of the production screen to the interior of the isolation pipe is controlled by the isolation pipe.

Shown somewhat in diagrammatic form in the figures are a series of valve members or sleeves 30 which are received within and movably mounted to the isolation pipe 26. Each of the sleeves 30 defines at least one aperture which is alignable with one or more ports in the isolation pipe, thereby providing fluid communication therewith when the aperture is aligned with the respective port.

Each of the sleeves 30 has an open position with the respective aperture in fluid communication with the related port, permitting fluid to pass from exterior of the screen 22 to interior of the isolation pipe 26. Each sleeve also has a closed position in which the associated aperture is not in fluid communication with the respective port. The closed position of the sleeve combines with the proximal end connections at coupling 27 and the distal end sealing by the seal assemblies 25 to prevent fluid communication from exterior of the screen to interior of the isolation pipe. As indicated, the basic configuration of a sliding valve sleeve as useful in the isolation assembly is known in the art, although the present manner of use of such an assembly has not previously been described.

The remaining portions of the overall well completion system comprise known components, although employed by the present invention in a novel overall system. Coupling 27 is threadedly coupled through blank pipe 31 is coupled with the production packer 11. The production packer is then conventionally connected with the hydraulic set and release tool 14. It will therefore be appreciated that the components of the well completion system are conveniently assembled together using conventional techniques. It is a particular advantage of the present invention that the system is assembled at the surface, including the isolation system which is permanently attached with the production screen. Means are provided for readily transitioning between various modes of operation of the system, including switching from a closed, isolation condition to an open, production condition.

Given the foregoing description of the novel isolation system and associated components, the assembly of the various assemblies will be within the ordinary skill in the art. Therefore, only a brief summary of the assembly process is provided hereafter.

In a preferred method, the system is inserted in typical fashion into a wellbore defined by casing 13. In the assembly process, the valve assembly 17, including the wash down set shoe 18 and the ball seat 20, is made up to the bottom of a sand control production screen 22 designed for the size and weight casing in which the assembly is to be installed. Most assemblies will then be run until one joint of blank pipe 23 is above the production screen. As is well understood, the assembly of these and other components is typically by screw threading of the components, such as by connection of the production screen 22 with blank pipe 23.

The isolation assembly includes the collet 24 and concentric seal assemblies 25 located between the collet and the isolation pipe 26. This isolation pipe in turn carries the isolation sleeves 30. The isolation assembly is permanently installed into the production screen and blank pipe assembly at the surface of the well, and the coupling 27 secured to the blank pipe 23 and isolation pipe 26. Then additional blank pipe 31 is run as appropriate to connect with the production packer assembly 11. The entire production packer assembly is mated up with the rig work string and lowered into the wellbore for installation.

The method of using the well completion system is illustrated in the drawings, which show successive conditions of a well in which the system is employed.

Referring in particular to FIG. 1, there is shown the well completion system of the present invention inserted into a well. The production screen 22 is located at the target depth in the area of the open hole 32 below the casing 13. As assembled, the system includes the isolation assembly 12 and apended valve assembly 17, as well as the production packer assembly 11 connecting with production tubing to the surface. In conventional fashion, the production packer assembly is coupled with the setting and release tool 14, which connects with production tubing 15 to the surface. In this condition with the isolation sleeves 30 in the closed position, fluid moving downwardly through the production tubing displaces and moves past the set shoe and out the end of the assembly. The fluid thereafter recirculates upwardly around the exterior of the well completion system (FIG. 1).

Figure 2:
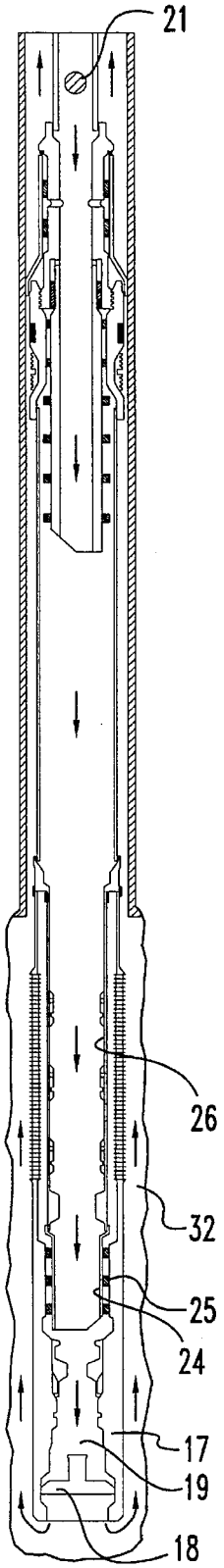
FIG. 2 is a side, cross-sectional, diagrammatic view of a well completion system of the present invention showing fluid being pumped into the well to deliver a valve closure ball.
Figure 3:
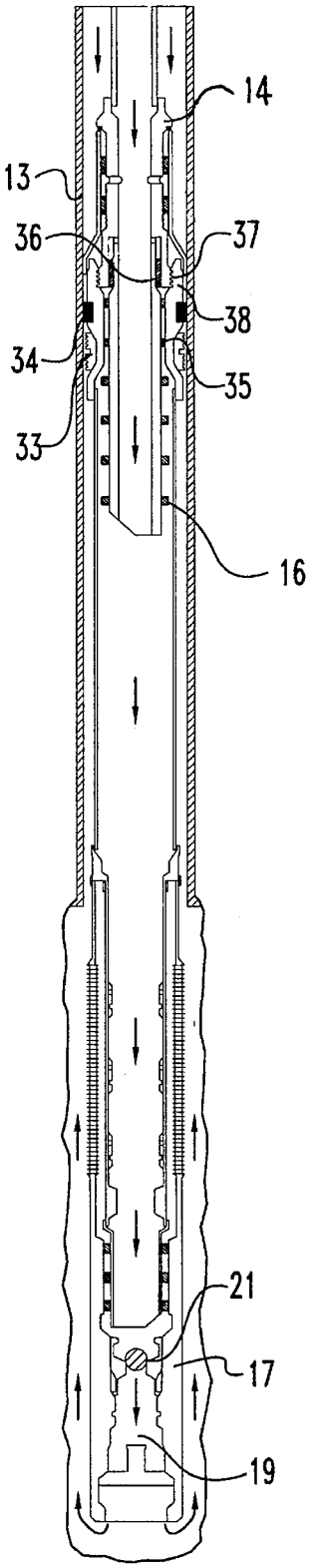
FIG. 3 is a side, cross-sectional, diagrammatic view of the system of FIG. 2 with the ball positioned in a ball seat and the packer set.

As shown in FIGS. 2 and 3, a ball 21 is then pumped down through the production tubing, carried by fluid moving along the flow path described with respect to FIG. 1. The ball is carried to the ball seat 20 (FIG. 3) and thereby seals the passageway and prevents further flow of fluid therethrough. With the passageway closed, the pressure within the system is increased until sufficient pressure is provided to activate the slip elements 33 and the packer elements 34 carried by the production packer assembly. The slip and packer elements engage and firmly grip the casing 13 to hold the assembly in position. The packer elements provide a fluid tight seal between the packer assembly and the casing wall (FIG. 3).

Figure 4:
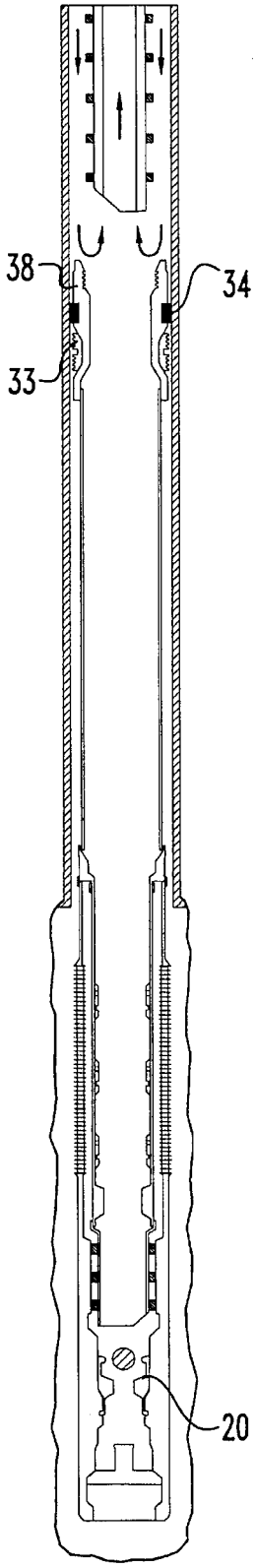
FIG. 4 is a side, cross-sectional, diagrammatic view of the system of FIG. 3, but with the packer setting tool and associated production tubing temporarily removed from the packer, and with the ball valve seat having been shifted downwardly to permit bypass flow.

With the system in the condition of FIG. 3, the pressure is further increased to a point that the ball seat is displaced downwardly to the position of FIG. 4. In a preferred embodiment, the ball seat 20 is of a typical design in which the seat is secured to the housing with shear pins which shear at a predetermined pressure and permit the ball seat to displace. In the new position of FIG. 4, a by-pass is open and fluid is permitted to flow past the ball seat and exit the set shoe.

Figure 5:
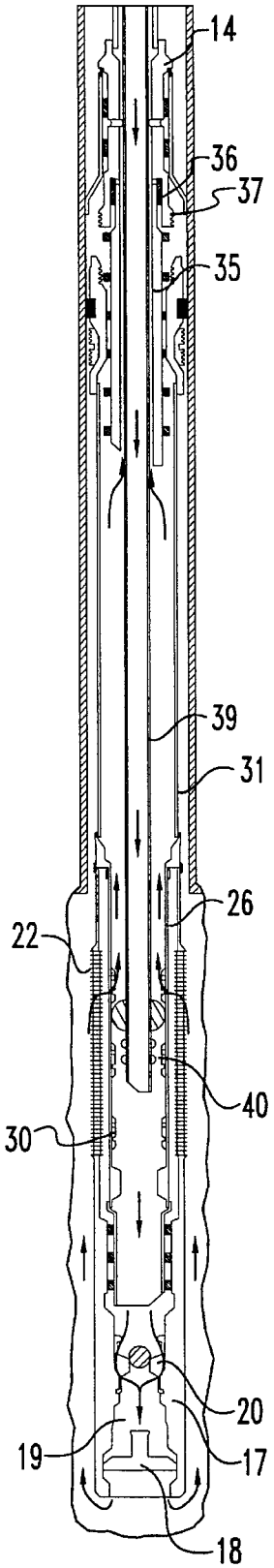
FIG. 5 is a side, cross-sectional, diagrammatic view of the well completion system of the present invention with coil tubing run down the center to open one of the sliding sleeve valves, and sealing the central passageway distally of the open sleeve valve to direct fluid flow as shown.
Figure 6:
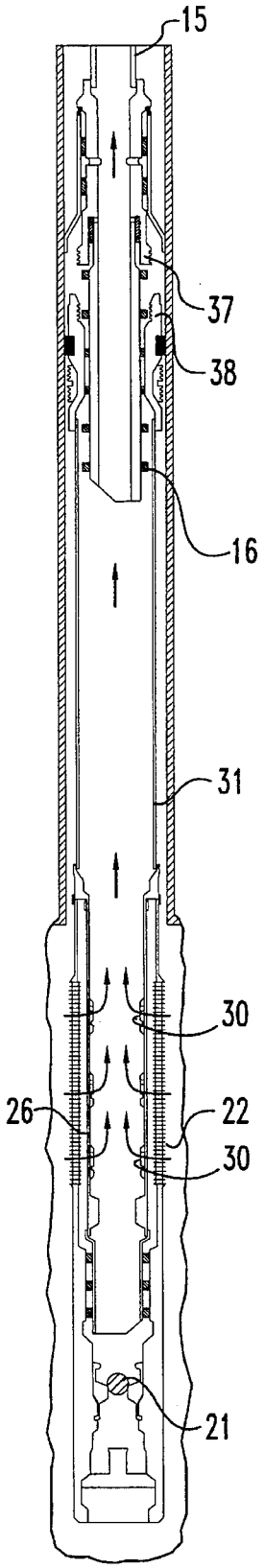
FIG. 6 is a side, cross-sectional, diagrammatic view of the well completion system with all of the sleeve valves open and in the production condition.

Also following the condition shown in FIG. 3, pressure applied in the annular region outside the production tubing is used to test the integrity of the packing elements of the set packer, as well as hydraulically release the production packer setting tool. In particular, the lower casing extension 16 is sealed with the production packer by production seals 35. Therefore, possible flow of fluid in the annular region outside the production tubing is restricted, and the integrity of the seals of the packing elements 34 with the casing is verified. Also, the pressure of the fluid in the annular region operates to displace the elements 36 (FIG. 3) upwardly (compare FIG. 5), allowing the coupling members 37 of the setting tool to retract radially inwardly and disengage from the complementary coupling members 38 of the production packer assembly. As shown in FIGS. 4 and 5, the production tubing and production seals are then allowed to be spaced out, and the tubing landed for production and wellhead installation.

As previously noted, a particular advantage of the present system and method is that a second trip into the well is not required in order to complete the preparation of the well for production. As shown particularly in FIG. 5, the final steps for preparing the well are accomplished simply by the use of coil tubing 39 run into the well through the production tubing. The coil tubing carries a shifting tool 40 which is operable to engage and shift the isolation sleeves 30 between the open and closed positions. The coil tubing also carries an inflatable pack-off element 41. In the present method, the shifting tool 40 is first used to open the uppermost isolation sleeve 30 and the pack-off element is positioned below this uppermost sleeve and inflated to seal the annulus between the coil tubing and the isolation pipe 26.

In the condition of FIG. 5, fluid pumped down the center of the coil tubing 39 is forced past the ball seat and the set shoe. The fluid exits the assembly and circulates upwardly on the outside until it moves through the production screen 22 and the topmost isolation sleeve. The fluid then passes upwardly through the annular region between the coil tubing and the production packer assembly. In this condition a breaker system is pumped across the open hole, and "soak time" is provided to assist in removing the drilling fluid filter cake. As is well known, such a filter cake is conventionally used to maintain stability of the open hole below the well casing, and removal of the filter cake precedes production of the well. The arrangement of the system in accordance with FIG. 5 provides for a desirable flow of the breaker system fluid upwardly within the open hole to facilitate removal of the filter cake.

With the filter cake removed, the pack-off element 41 is deflated and the shifting tool 40 is used to open the remainder of the isolation sleeves 30. The coil tubing and associated equipment is then removed and the well is ready for production.

It will be appreciated that the foregoing description relates to a somewhat simplified and diagrammatic view of the various components of the present invention. Several of these components, such as the production packer assembly, the set and release tool, and the wash down set shoe and shearable ball seat are well known in the industry and therefore familiar to those skilled in the ark. It will therefore be appreciated that these components may include a multiplicity of members interconnected in conventional fashion, e.g. by threaded connection or the like. For example, items shown as a single pipe may comprise several pipes connected together with threaded couplings to provide an overall member of desired length.

Similarly, the particular configuration of the isolation/production screen assembly can vary. A particular aspect of the assembly is that the isolation system is secured to the production screen and sealed both proximally and distally of the screen.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for completion of a well having a well casing and an open hole below the well casing, the method comprising the steps of:

(a) running into the well a well completion assembly comprising: a packer assembly for providing a seal with the well casing; production tubing sealed with said packer assembly; and an isolation assembly coupled with said packer assembly, said isolation assembly comprising a cylindrical production screen having a proximal end and a distal end, the screen defining an area of fluid passage between a screen interior and a screen exterior; an isolation pipe defining at least one port therethrough, the isolation pipe having a proximal end and a distal end, at least one of the proximal and distal ends being affixed to the production screen; first sealing means for sealing the proximal end of the isolation pipe with the production screen; second sealing means for sealing the distal end of the isolation pipe with the production screen; a sleeve movably coupled with the isolation pipe, the sleeve defining at least one aperture, the sleeve having an open position with the aperture of the sleeve in fluid communication with the port in the isolation pipe, the sleeve having a closed position with the aperture of the sleeve not in fluid communication with the port of the isolation pipe, the sleeve in the open position permitting fluid passage between the exterior of the screen and the interior of the isolation pipe, the sleeve in the closed position preventing fluid passage between the exterior of the screen and the interior of the isolation pipe, the sleeve initially being in the closed position; and a one-way check valve attached adjacent the distal end of the isolation pipe, the check valve in the open position permitting fluid passage from the interior of the isolation pipe to the exterior of the isolation pipe, the check valve in the closed position preventing fluid passage from the exterior of the isolation pipe to the interior of the isolation pipe;

(b) setting the packer assembly to seal against the well casing; and (c) moving the sleeve of the isolation assembly to the open position.

2. The method of claim 1 in which step (c) comprises running into the well continuous coil tubing having at its distal end a sleeve engaging means for engaging the sleeve of the isolation assembly to move it from the closed position to the open position.

3. An apparatus for completion of a well having a well casing and an open hole below the well casing, the apparatus comprising:

a packer assembly for providing a seal with the well casing;

production tubing sealed with said packer assembly; and an isolation assembly coupled with said packer assembly, said isolation assembly comprising:

a cylindrical production screen having a proximal end and a distal end, said screen defining an area of fluid passage between a screen interior and a screen exterior;

an isolation pipe defining at least one port therethrough, said isolation pipe having a proximal end and a distal end, at least one of the proximal and distal ends being affixed to said production screen;

first sealing means for sealing the distal end of said isolation pipe with said production screen;

a sleeve movably coupled with said isolation pipe, said sleeve defining at least one aperture, said sleeve having an open position with the aperture of said sleeve in fluid communication with the port in said isolation pipe, said sleeve having a closed position with the aperture of said sleeve not in fluid communication with the port of said isolation pipe, said sleeve in the open position permitting fluid passage between the exterior of said screen and the interior of said isolation pipe, said sleeve in the closed position preventing fluid passage between the exterior of said screen and the interior of said isolation pipe; and a one-way check valve attached adjacent said isolation pipe distal end, said check valve having an open position permitting fluid passage from the interior of said isolation pipe to the exterior of said isolation pipe and a closed position preventing fluid passage frown the exterior of said isolation pipe to the interior of said isolation pipe.

4. A combination production tubing and isolation apparatus for insertion into a wellbore as an integral unit for single trip open hole well completion which comprises:

a packer assembly having an inner bore, an exterior surface, and proximal and distal ends, said packer assembly having at least one aperture from said inner bore to said exterior surface;

production tubing selectively engaging said packer assembly adjacent said proximal end;

a production screen attached to said exterior surface covering said at least one aperture;

an isolation valve connected to the inner bore of said packer assembly adjacent said production screen, said isolation valve controllable between an open position permitting fluid flow through said screen and a closed position inhibiting fluid flow through said screen; and a one-way check valve attached to the distal end of said packer assembly having an open position permitting fluid passage from the interior of said packer assembly to the exterior of said packer assembly and a closed position preventing fluid passage from the exterior of said packer assembly to the interior of said packer assembly.

5. A method for isolating and producing a well on a single trip into the wellbore, the well having a well casing and an open hole below the well casing, said method comprising the steps of:

(a) running into the wellbore a completion assembly comprising; a packer assembly having a production screen with a production screen isolation valve disposed interior of the screen, and production tubing, the production tubing selectively engaging said packer assembly to provide: (i) a first flow path from the interior of the completion assembly at a location below the packer to the annulus between the completion assembly and the open hole wellbore and (ii) a second flow path from the exterior of the production tubing above the packer to the interior of the production tubing above the packer;

(b) selectively operating the production tubing to establish the first flow path;

(c) injecting fluid through the production tubing;

(d) sealingly engaging the packer assembly to the well casing adjacent the desired production zone for maintaining the position of the packer assembly and sealing the annulus between the packer assembly and the wellbore;

(e) opening the isolation valve to allow fluid flow through the production screen by running coil tubing into the production tubing having at its distal end a valve engaging means, selectively engaging the isolation valve with the engaging means and positioning the isolation valve to the open position;

(f) running the distal end of the coil tubing below the open isolation valve, the coil tubing having an inflatable pack-off element sealably attached adjacent the distal end of said coil tubing;

(g) inflating the inflatable pack-off element;

(h) injecting breaker system fluid through the coil tubing, the fluid exiting the coil tubing below the inflatable pack-off element;

(i) deflating the pack-off element; and (j) removing the coil tubing.

* * * * *